US005437248A

United States Patent [19]

Miura et al.

[11] Patent Number: 5,437,248

[45] Date of Patent: Aug. 1, 1995

[54] FIRE TUBE BOILER

[75] Inventors: Tamotsu Miura; Masatoshi Miura; Osamu Higuchi, all of Matsuyama, Japan

[73] Assignee: Miura Co., Ltd., Ehime, Japan

[21] Appl. No.: 92,079

[22] Filed: Jul. 16, 1993

[30] Foreign Application Priority Data

Jul. 23, 1992 [JP] Japan ..... 4-218228
Mar. 19, 1993 [JP] Japan ..... 5-085687

[51] Int. Cl.[6] ..... F22B 9/08

[52] U.S. Cl. ..... 122/51; 122/16; 122/17

[58] Field of Search ..... 122/16, 17, 51, 52, 122/68, 103, 149; 165/134.1

[56] References Cited

U.S. PATENT DOCUMENTS 1,483,227 2/1924 Kohlmeyer ..... 122/16
3,317,222 5/1967 Maretzo ..... 165/134.1
4,440,113 4/1984 Förster et al. ..... 122/16
4,676,199 6/1987 Daugirda et al. ..... 122/17
4,936,260 6/1990 Adams ..... 122/17 X

FOREIGN PATENT DOCUMENTS 352242 2/1930 United Kingdom ..... 122/16

*Primary Examiner*—Raymond A. Nelli

[57] ABSTRACT

A fire tube boiler having a combustion chamber equipped with a burner, and a group of fire tubes provided adjacent to the combustion chamber. The fire tube boiler further includes a heat exchanger disposed in the combustion chamber and serving for heat exchange with combustion flame from the burner. The combustion chamber is divided into a first combustion chamber and a second combustion chamber by the disposition of the heat exchanger. Furthermore, the heat exchanger is disposed in proximity to the burner so that the combustion flame in the first chamber is less than 1500° C. and the combustion flame in the second chamber is between 1100° and 1400° C. Thus, the fire tube boiler allows further reduction in harmful exhausts such as NOx and CO.

9 Claims, 9 Drawing Sheets

FIRE TUBE BOILER

BACKGROUND OF THE INVENTION

1. Field of the Invention

The present invention relates to fire tube boilers having a novel structure of boiler shell.

2. Description of the Prior Art

Conventionally, there have been used fire tube boilers in which a large number of fire tubes with an approximately 100 mm diameter are arranged on the boiler drum. This type of fire tube boiler is so constructed that combustion gas is flowed through within the fire tubes to heat the water surrounding them. Fire tube boilers have as an advantage the capability of generating a large amount of steam (hot water) for their sizes, compared with flue boilers.

However, the above-mentioned fire tube boilers are confronting a problem upon discharge of harmful exhausts such as a nitrogen oxide (NOx). The discharge of these harmful exhausts are of intensely growing importance under the recent years' circumstances that environmental problems are being considered more and more significant, accompanied by further stricter administrative regulations.

SUMMARY OF THE INVENTION

Accordingly, the present invention has been developed with a view to solving the foregoing problem, and its object is to provide a fire tube boiler having a combustion chamber equipped with a burner, and a group of fire tubes provided adjacent to the combustion chamber. The fire tube boiler comprising a heat exchanger disposed in the combustion chamber and serving for heat exchange with combustion flame from the burner, wherein the combustion chamber is divided into a first combustion chamber and a second combustion chamber by the disposition of the heat exchanger.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENTS

Figure 1:
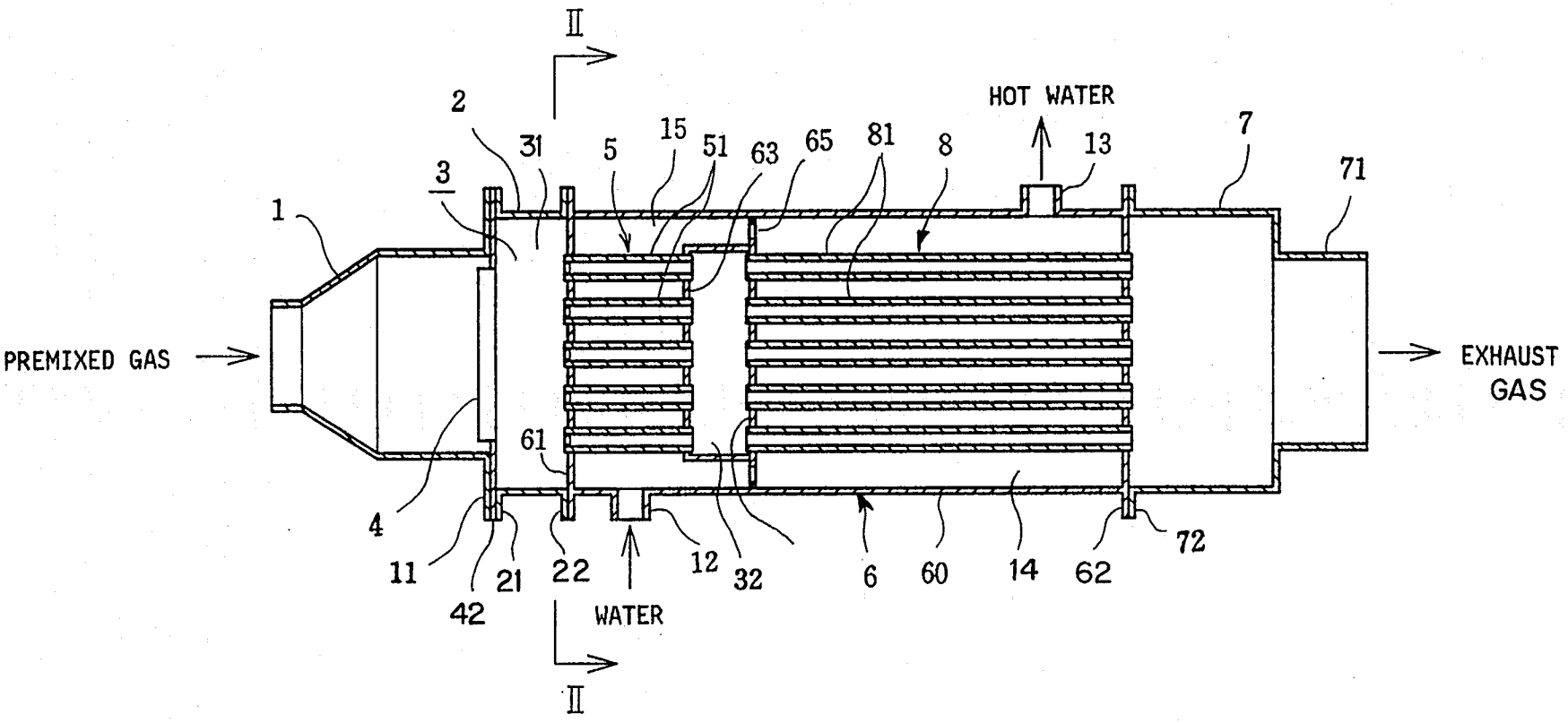
FIG. 1 is a longitudinal sectional view showing an embodiment of the fire tube boiler according to the present invention.
Figure 2:
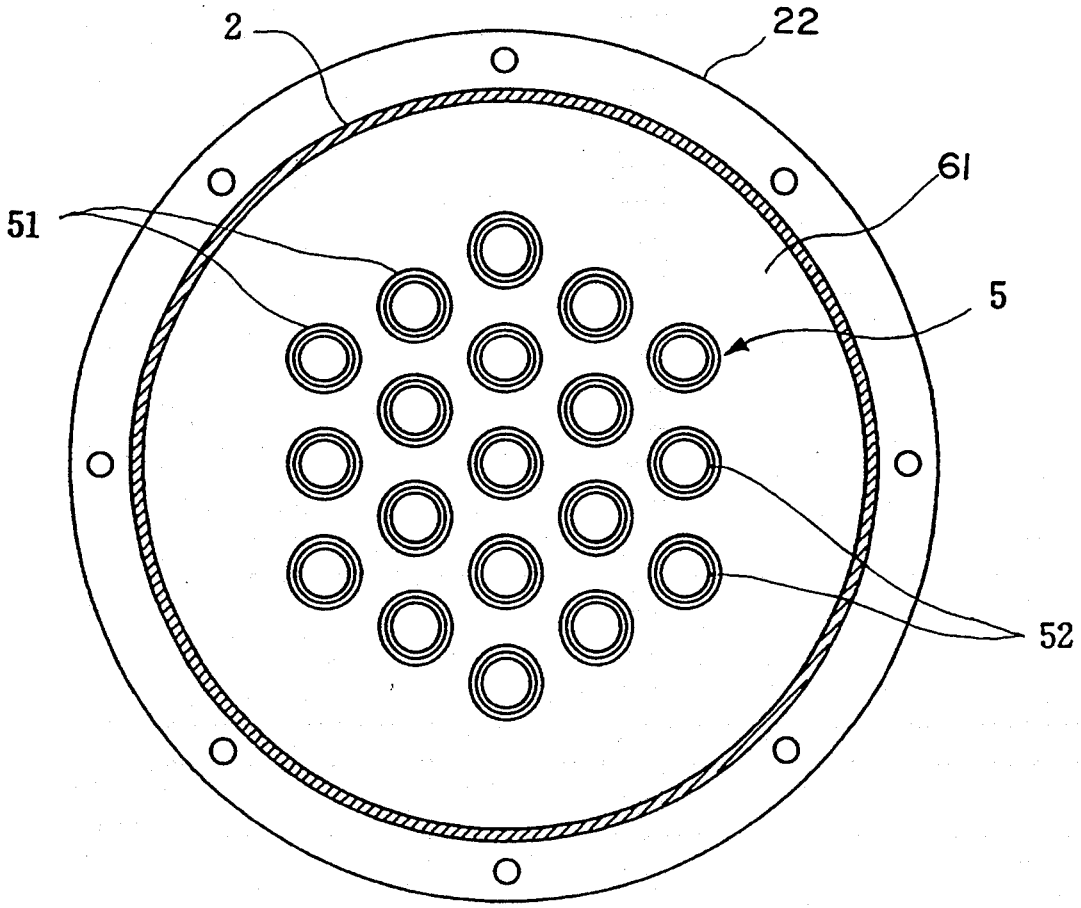
FIG. 2 is an enlarged sectional view taken along the line II—II of FIG. 1.

Now an embodiment of the fire tube boiler according to the present invention is described with reference to the accompanying drawings. Referring to FIGS. 1 and 2, a fire tube boiler according to the present invention comprises a mixed gas drum 1, a combustion drum 2, a shell 6, and a stack base 7, these components being coupled with one another. The mixed gas drum 1 having a flange 11 is fed from upstream with a premixed gas in which fuel gas and combustion air have been premixed. The combustion drum 2, which also serves as part of a combustion chamber 3, has flanges 21 and 22 at both ends. The flange 11 of the mixed gas drum 1 is coupled with the flange 21 of the combustion drum 2. The shell 6 has at both ends tube plates 61 and 62, which also serve as part of flanges. The stack base 7 has a stack 71 and a flange 72. One tube plate 61 of the shell 6 is coupled with the flange 22 of the combustion drum 2, and the other tube plate 62 to the flange 72 of the stack base 7.

The combustion chamber 3 is equipped with a burner 4. The burner 4 is fixed by bolts or the like so as to be sandwiched between one flange 21 of the combustion drum 2 and the flange 11 of the mix ed gas drum 1.

The combustion chamber 3 is provided therein with a heat exchanger 5 that allows combustion flame (meaning the gas under combustion reaction, which could also be referred to as burning gas or under-combustion gas) from the burner 4 to pass therethrough in linear fashion. By this heat exchanger 5, the combustion chamber 3 is divided into a first combustion chamber 31 and a second combustion chamber 32. The heat exchanger 5 mentioned above is disposed in proximity to the burner 4, allocating one combustion chamber on the burner 4 side to the first combustion chamber 31, and the other combustion chamber to the second combustion chamber 32.

In the embodiment as shown in FIG. 1, the heat exchanger 5 is so constructed that a plurality of fire tubes 51 are arranged between the tube plate 61 and a tube plate 63. The diameter, length, number of units, and distance to the burner of the fire tubes 51 are so set that the combustion flame temperature of the first combustion chamber 31 will be below approx. 1500° C., and that the combustion flame temperature of the second combustion chamber 32 will fall in the range of approx. 1100° to 1400° C., more preferably, 1200° to 1300° C. Setting the combustion flame temperature of the first combustion chamber 31 below 1500° C. suppresses the generation of thermal NOx. Further, setting the combustion flame temperature of the second combustion chamber 32 facilitates the oxidation reaction from a carbon monoxide (CO) to a carbon dioxide ($CO_2$), suppressing the dissociation from $CO_2$ to CO, by which reduction in CO amount becomes a reality.

On the side opposite to the heat exchanger 5 over the second combustion chamber 32, there is provided a fire tube group 8 adjacent to the second combustion chamber 32. This fire tube group 8 is so constructed that a large number of fire tubes 81 are arranged between a tube plate 64 and the tube plate 62. Covering the outer periphery of the fire tube group 8 with a cylindrical outer casing 60 makes up the boiler shell 6, while a liquid reservoir space 14 is formed between the exterior of the fire tubes 81 and the outer casing 60. In the embodiment as shown in FIG. 1, another liquid reservoir space 15 is formed between the exterior of the fire tubes 51 and the outer casing 60, where these liquid reservoir spaces 14 and 15 communicate with each other via a communicating hole 65 bored in the tube plate 64. The outer casing 60 is provided with a water inlet port 12 for feeding water into the liquid reservoir space 15 and a hot water outlet port 13 for feeding hot water from the liquid reservoir space 14 to the outside.

Figure 3:
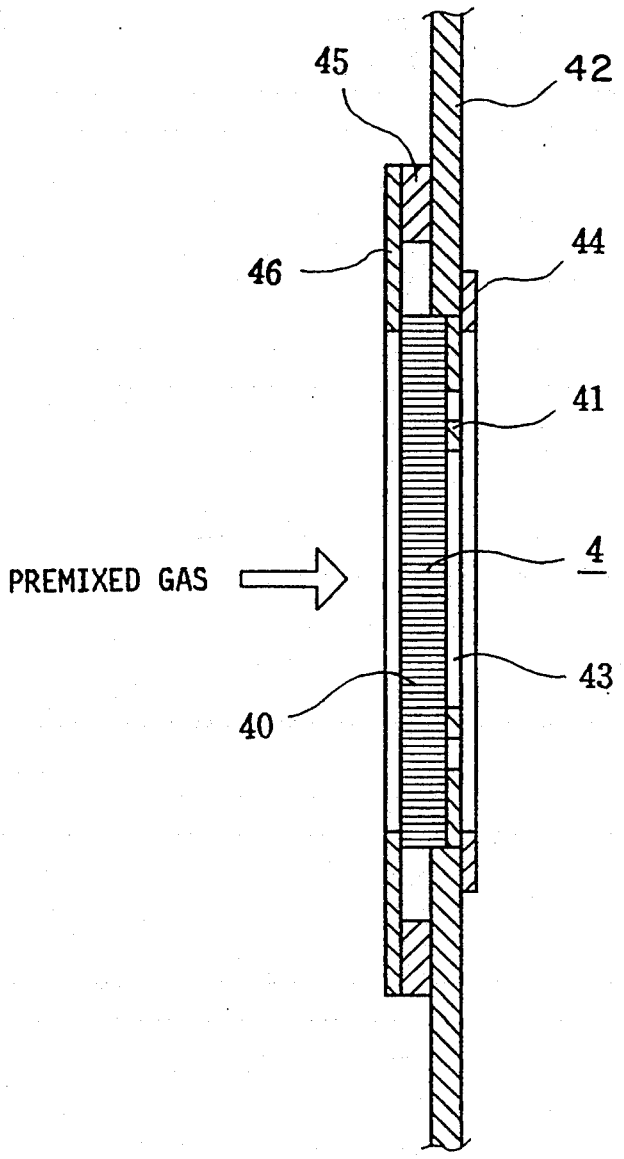
FIG. 3 is a longitudinal sectional view showing a burner applied to the fire tube boiler of the invention.
Figure 4:
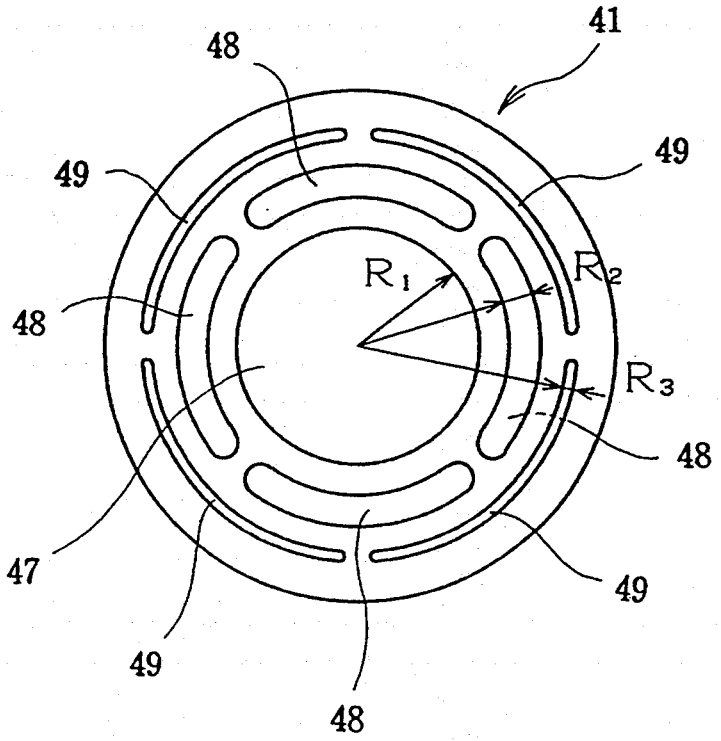
FIG. 4 is a front view showing a flame dividing plate serving as part of the burner shown in FIG. 3.

FIGS. 3 and 4 illustrate an actual example of the burner 4. The burner 4 has a burner element 40 and a flame dividing plate 41 provided on the combustion surface of the burner element. The burner element 40 is formed in a cylindrical shape, for example, by overlaying a flat plate and a corrugated plate one on the other and winding them around in a spiral manner. The burner 4 has a burner fixing plate 42 and, besides, a guide plate 44 secured around one side of a burner fitting opening 43 and a burner holding seat 45 secured around the other side, both through welding or the like. A burner holding plate 46 is removably secured to the burner holding seat 45 with screws, with the burner element 40 and the flame dividing plate 41 sandwiched between the burner holding plate 46 and the guide plate 44.

The arrangement of the opening of the flame dividing plate 41 is as shown in FIG. 4. More specifically, a large-diameter circular opening portion 47 is located at the center, a plurality of first-round arc opening portions 48, 48 are arranged on the outer periphery of the circular opening portion 47, and further a plurality of second-round arc opening portions 49, 49 are arranged on the outer periphery of the first-round arc opening portions 48, 48. The inner diameter $R_1$ of the circular opening portion 47, the radial width $R_2$ of the first-round arc opening portions 48, and the radial width $R_3$ of the second-round arc opening portions 49 are in such an interrelation that the farther the round goes outward, the smaller the magnitude becomes. Such an arrangement allows a long, wide flame to be formed at the center of the burner, and shorter, narrower flames (sub-flames) to be formed one by one on the periphery of the flame, thus making it possible to implement stable combustion with less oscillating combustion.

Figure 5:
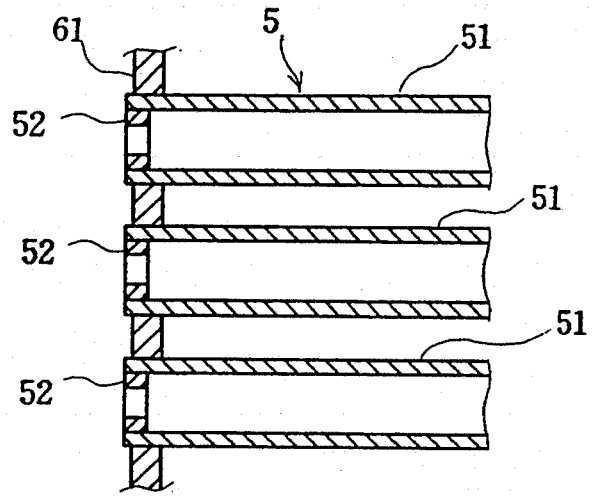
FIG. 5 is a longitudinal sectional view showing in enlargement the protective member attached portion of FIG. 1.

As illustrated in FIG. 5, the fire tubes 51 constituting the heat exchanger 5 have protective members 52 disposed at the opening portions on the side opposite to the burner 4. Each of these protective members 52 consists of a ring-shaped member, being removably fitted into the opening portion of a fire tube 51. That is, the protective members 52 each have such an outer diameter that they can be fitted into the interior of the fire tubes 51, as well as an inner diameter smaller than the inner diameter of the fire tubes 51.

Figure 6:
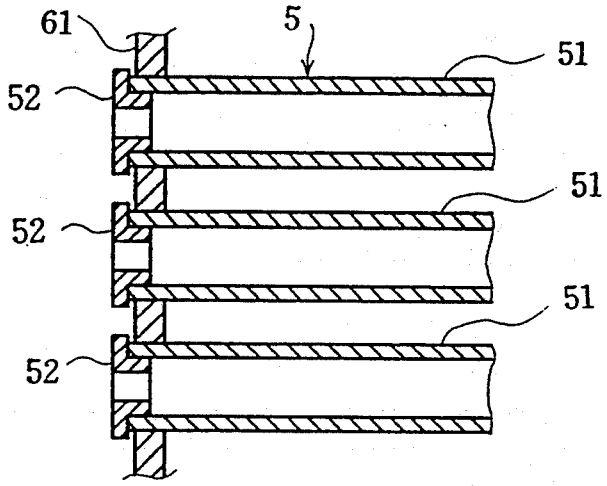
FIG. 6 is a longitudinal sectional view showing in enlargement another embodiment of the protective member attached portion of FIG. 1.
Figure 7:
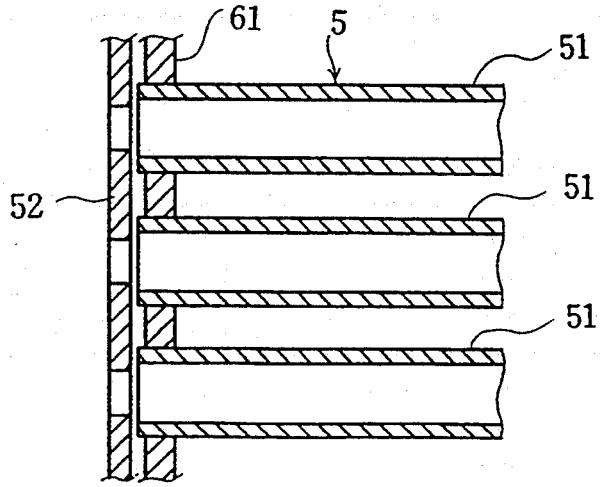
FIG. 7 is a longitudinal sectional view showing in enlargement yet another embodiment of the protective member attached portion of FIG. 1.

FIGS. 6 and 7 illustrate other examples of the protective members 52. In the example as shown in FIG. 6, collars are formed at ends of the ring-shaped protective members 52, the protective members 52 being fitted into the opening portions of the fire tubes 51. The collars are so arranged as to cover the entire end portions of the fire tubes 51. In contrast, in the example as shown in FIG. 7, a protective member 52 is formed by one sheet of flat plate, being arranged so as to confront the opening portions of the fire tubes 51. This protective member 52 has through holes, their diameter being smaller than the inner diameter of each fire tube 51, formed at positions corresponding to the fire tubes 51.

With the above-described construction, the operation of the fire tube boiler is now described.

First, a premixed gas fed to the mixed gas drum 1 is injected from the combustion surface of the burner 4 into the first combustion chamber 31, where it burns. At this point, the burner 4 has divisional flames formed by its opening portions 47, 48, and 49, allowing low NOx combustion to be effected by these divisional flames. At the same time, the flames are rapidly cooled by the heat exchanger 5 (where the combustion flame temperature in the first combustion chamber 31 is approximately below 1500° C.), which suppresses the generation of thermal NOx.

Then the combustion flame (meaning the gas under combustion reaction, which could also be referred to as burning gas or under-combustion gas) from the burner 4 passes through the heat exchanger 5 into the second combustion chamber 32. In this second combustion chamber 32, the combustion flame temperature is approximately 1200° to 1300° C. due to heat exchange with the heat exchanger 5. Accordingly, CO that has insufficiently progressed in oxidation reaction during the heat exchange with the heat exchanger 5 is oxidized into $CO_2$ by the combustion in the second combustion chamber 32, without involving dissociation from $CO_2$ to CO, by which reduction in CO amount can be realized. Further, since the reaction is carried out in temperature ranges below 1300° C., generation of thermal NOx is also suppressed.

Thereafter, the exhaust gas that has almost completed combustion reaction passes through the fire tube group 8, and is then discharged via the stack base 7 and the stack 71 to outside of the system.

During the above processes, the water that has flowed in through the water inlet port 12 is heated by heat derived from the heat exchanger 5 and the fire tube group 8 while it further flows from the liquid reservoir space 15 into the liquid reservoir space 14 via the communicating hole 65 of the tube plate 64. The heated hot water is then fed to external through the hot water outlet port 13.

Meanwhile, when high-temperature combustion flames flow inward of the fire tubes 51, there arise swirls on the rear-stream side of the protective members 52 within the fire tubes 51, causing unburnt constituents to be agitatedly mixed with high-temperature reactive portions, so that the combustion performance is improved. Such overheating due to high-temperature combustion flame as would be involved in conventional cases will take place in the inner peripheral faces of the protective members 52 at which the flow rate increases, thus eliminating the possibilities of overheating and burnout of the portions in the vicinity of the junction between the fire tubes 51 and the tube plate 61. The protective members 52, which are fitted so as to be removable, can be readily replaced with another if the protective members 52 should be burned out.

Although the fire tube boiler according to the present invention has been described heretofore as a boiler for use of hot water generation, yet it may be modified to another for use of steam generation by additionally providing a steam chamber upward of the liquid reservoir space 14.

Figure 8:
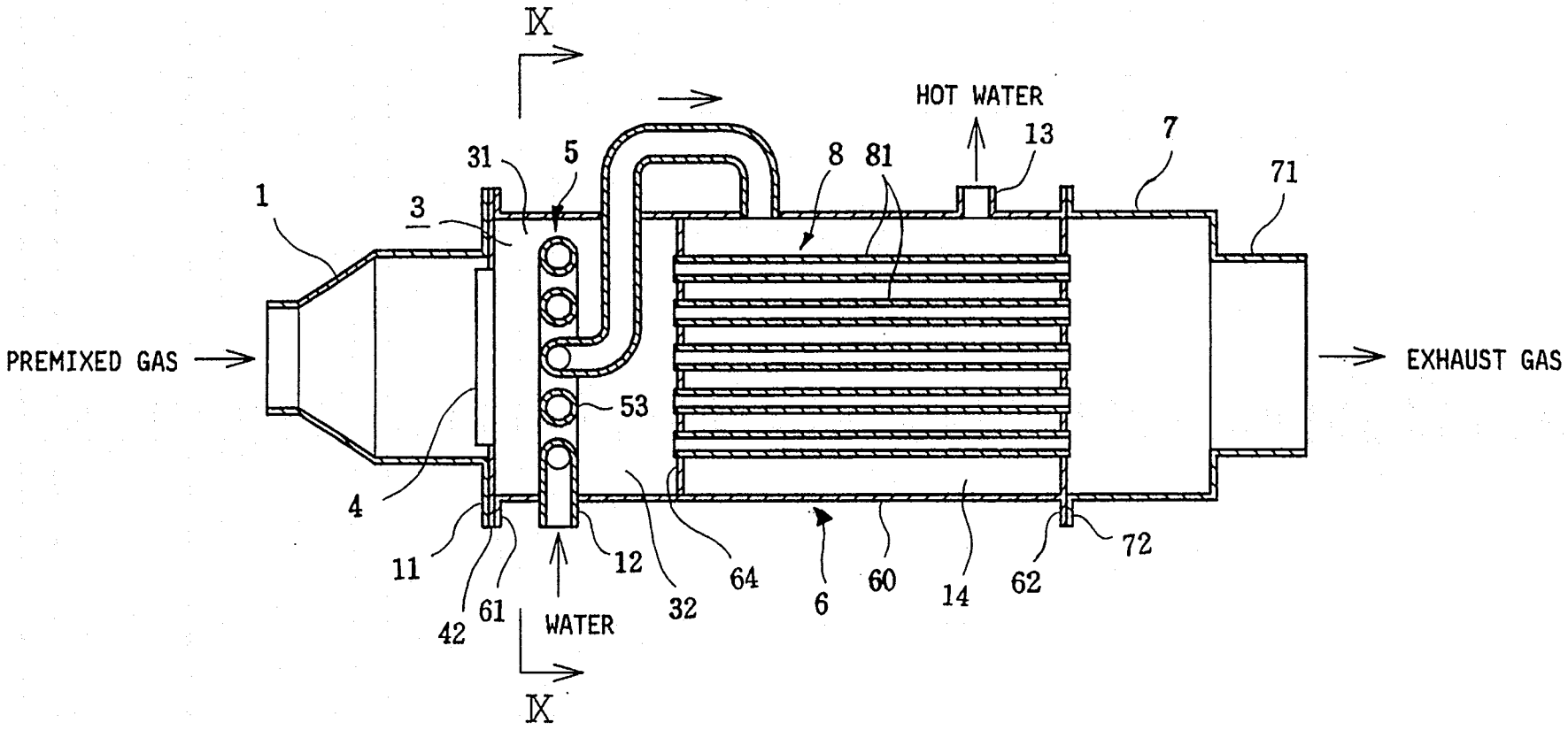
FIG. 8 is a longitudinal sectional view showing another embodiment of the fire tube boiler according to the present invention.
Figure 9:
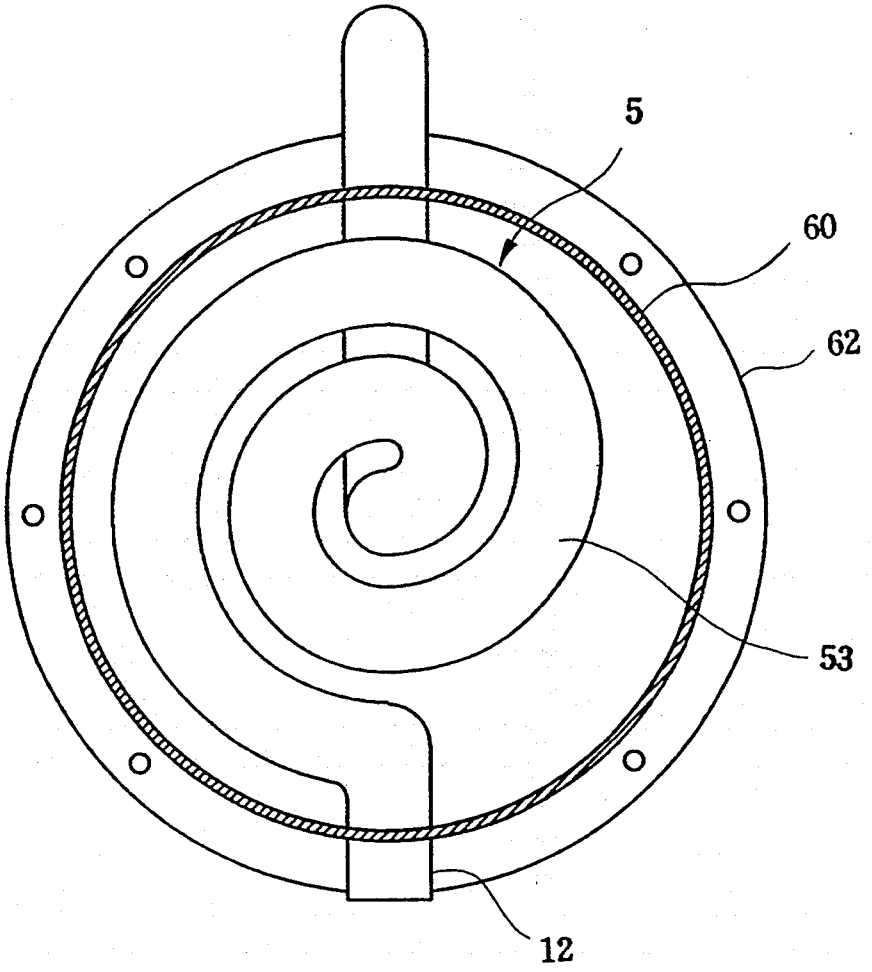
FIG. 9 is an enlarged sectional view taken along the line IX—IX of FIG. 8.

Other embodiments of the heat exchanger 5 are shown in FIGS. 8 to 11. In one example as shown in FIGS. 8 and 9, the heat exchanger 5 is implemented by a coiled water tube 53. A water inlet port 12 is provided at one end of the coiled water tube 53, the other end thereof being connected to a liquid reservoir space 14. The coiled water tube 53 is formed into a scroll shape with specified spacings maintained, thereby forming a scroll passage through which combustion flame from the burner 4 will pass.

Figure 10:
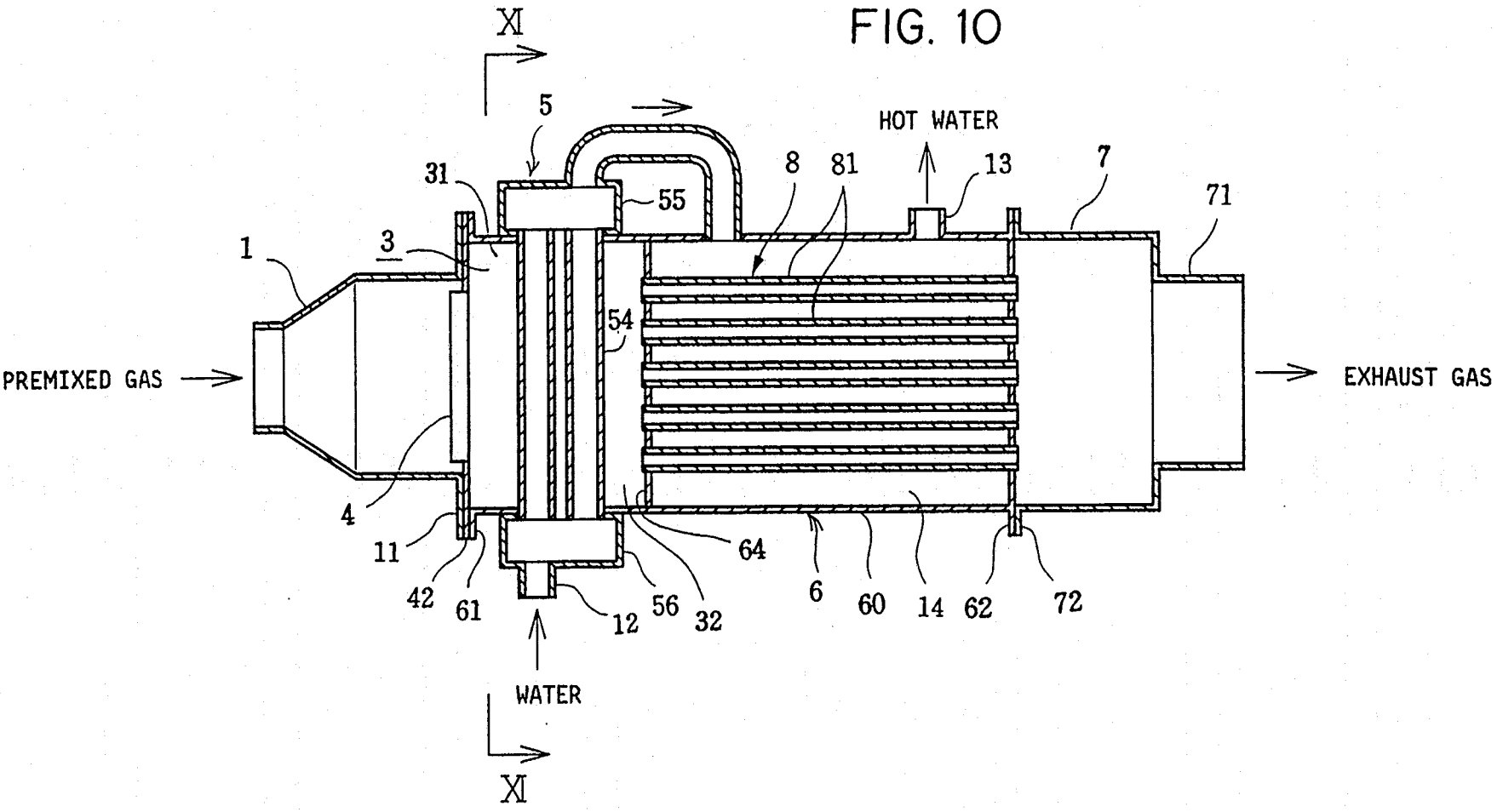
FIG. 10 is a longitudinal sectional view showing yet another embodiment of the fire tube boiler according to the present invention.
Figure 11:
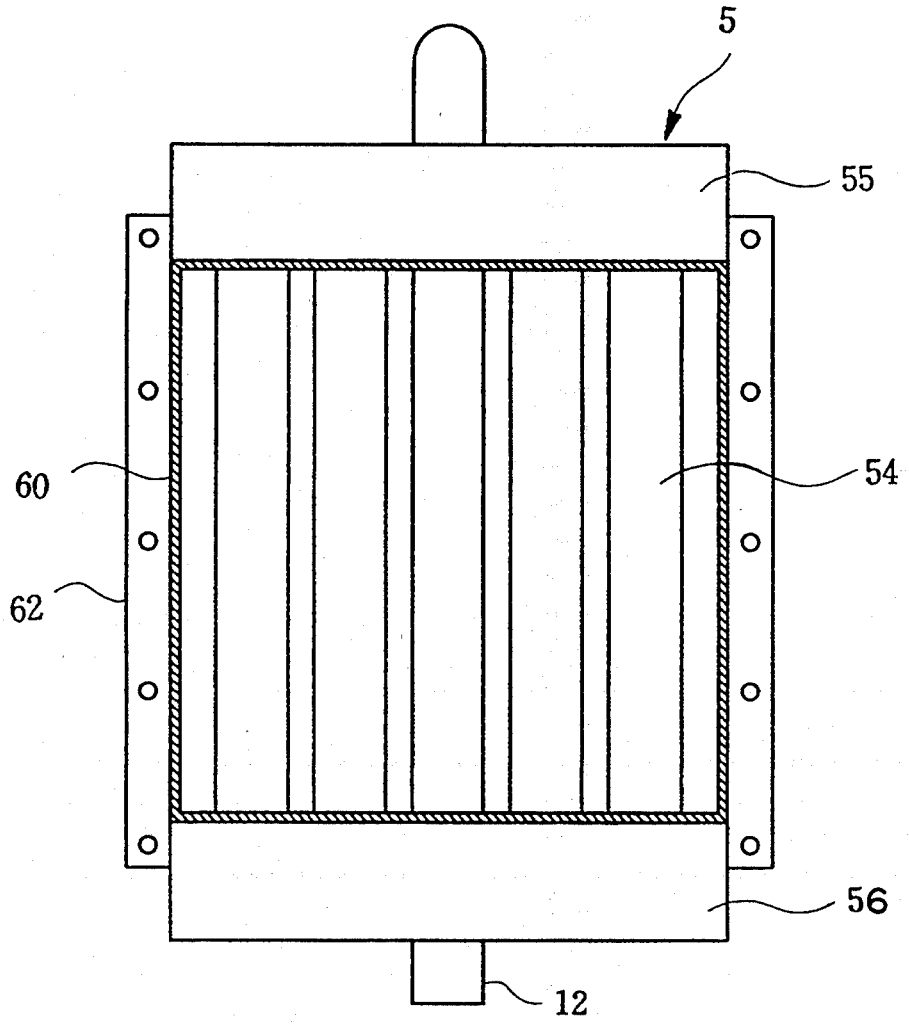
FIG. 11 is an enlarged sectional view taken along the line XI—XI of FIG. 10.

On the other hand, in the example as shown in FIGS. 10 and 11, the outer casing 60 is formed in section into a rectangular shape, while the heat exchanger 5 comprises a plurality of vertical water tubes 54 interconnected between top header 55 and bottom header 56 both of substantially rectangular shape. These vertical water tubes 54 are arranged with specified intervals one another, the intervals serving as a passage through which combustion flame from the burner 4 will pass. A water inlet port 12 is provided to the bottom header 56, and the top header 55 is connected to the liquid reservoir space 14.

According to the fire tube boiler of the present invention, a heat exchanger is provided within the combustion chamber to perform heat exchange with combustion flame from the burner, whereby the combustion chamber is divided into a first combustion chamber and a second combustion chamber, thus making it possible to further suppress harmful exhausts including NOx and CO. Yet, since the first combustion chamber, the heat exchanger, the second combustion chamber, and the fire tube group are arranged substantially in straight line, the resulting pressure loss is small with respect to the flow of gas. As a result, the boiler can be reduced in size and increased in efficiency.

By virtue of the arrangement that the combustion flame temperature in the first combustion chamber is made below 1500° C. and that the combustion flame temperature in the second combustion chamber is made in the range of 1100° to 1400° C., it is possible to further suppress harmful exhausts including NOx and CO.

Furthermore, by the arrangement that at the entrances of the fire tubes there are provided protective members having an inner diameter smaller than the diameter of the entrances of the fire tubes, overheating and burnout can be efficiently prevented at the portions in the vicinity of the junction between fire tubes and tube plate due to high-temperature combustion flame that flow inward of the fire tubes. Even if the protective members should be burned out, they can be readily replaced with another because the protective members are removably fitted. Yet further, there will arise swirls on the rear-stream side of the protective members within the fire tubes, causing unburnt constituents to be agitatedly mixed with high-temperature reactive portions, so that the combustion performance is improved.

Although the present invention has been fully described by way of example with reference to the accompanying drawings, it is to be noted here that various changes and modifications will be apparent to those skilled in the art. Therefore, unless otherwise such changes and modifications depart from the scope of the present invention as defined by the appended claims, they should be construed as included therein.

What is claimed is:

1. A fire tube boiler comprising:

a combustion chamber;

a burner supplying combustion flame to said combustion chamber;

a heat exchanger disposed in said combustion chamber and dividing said combustion chamber into a first and second chamber, said heat exchanger allowing passage of said combustion flame from said first chamber to said second chamber, said heat exchanger being disposed in said combustion chamber in proximity to said burner so that said combustion flame in said first chamber is less than 1500° C. and said combustion flame in said second chamber is between 1100° and 1400° C.; and a plurality of fire tubes allowing passage of said combustion flame in said second chamber to an exhaust.

2. The fire tube boiler of claim 1, wherein said heat exchanger is disposed in said combustion chamber in proximity to said burner so that said combustion flame in said first chamber is less than 1500° C. and said combustion flame in said second chamber is between 1200° and 1300° C.

3. A fire tube boiler as claimed in claim 1, wherein the heat exchanger comprises a plurality of fire tubes.

4. A fire tube boiler as claimed in claim 1, wherein the heat exchanger is implemented by a coiled water tube.

5. A fire tube boiler as claimed in claim 1, wherein the heat exchanger comprises a plurality of vertical water tubes interconnected between a top header a bottom header.

6. A fire tube boiler as claimed in claim 3, wherein at entrances of the fire tubes there are provided protective members having an inner diameter smaller than the diameter of the entrances of the fire tubes.

7. The fire tube boiler of claim 3, further comprising:

cylindrical protective members disposed inside said fire tubes of said heat exchanger at an opening of said fire tubes of said heat exchanger to said first chamber.

8. The fire tube boiler of claim 3, further comprising:

a plurality of protective members, each protective member having a cylindrical portion and a flange portion, said cylindrical portion being disposed in a fire tube of said heat exchanger.

9. The fire tube boiler of claim 3, further comprising:

a protective member disposed at an opening of each fire tube of said heat exchanger to said first chamber, said protective member being annular with an outer diameter greater than a diameter of said opening and an inner diameter less than said diameter.

* * * * *